US008073371B2

(12) United States Patent
Yamamoto

(10) Patent No.: US 8,073,371 B2
(45) Date of Patent: Dec. 6, 2011

(54) IMAGE FORMING APPARATUS WHICH CORRECTS THE CURL OF A DISCHARGE SHEET

(75) Inventor: Shin Yamamoto, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 540 days.

(21) Appl. No.: 11/623,861

(22) Filed: Jan. 17, 2007

(65) Prior Publication Data

US 2007/0172278 A1 Jul. 26, 2007

(30) Foreign Application Priority Data

Jan. 17, 2006 (JP) ..... 2006-008498

(51) Int. Cl.
*G03G 15/20* (2006.01)

(52) U.S. Cl. ..... 399/323; 399/406; 271/307

(58) Field of Classification Search ..... 399/323, 399/398, 399, 405, 406; 271/307, 311, 900; 162/270, 271

See application file for complete search history.

(56) References Cited

U.S. PATENT DOCUMENTS

| | | | | |
|---|---|---|---|---|
| 4,179,116 | A * | 12/1979 | Umezawa et al. | 271/306 |
| 5,138,391 | A * | 8/1992 | Takahashi et al. | 399/327 |
| 5,187,527 | A * | 2/1993 | Forlani et al. | 399/406 |
| 5,787,330 | A * | 7/1998 | Funato | 399/390 |
| 5,999,788 | A * | 12/1999 | Kanesawa et al. | 399/329 |
| 6,259,888 | B1 | 7/2001 | Kazama et al. | |
| 2003/0147681 | A1 * | 8/2003 | Suenaga | 399/406 |
| 2003/0190180 | A1 * | 10/2003 | Katayanagi et al. | 399/406 |
| 2004/0067082 | A1 * | 4/2004 | Uehara et al. | 399/341 |
| 2004/0146323 | A1 * | 7/2004 | Fujisawa et al. | 399/323 |
| 2004/0228665 | A1 * | 11/2004 | Tomatsu | 399/322 |

FOREIGN PATENT DOCUMENTS

| | | |
|---|---|---|
| JP | 01-189669 | 7/1989 |
| JP | 10-231061 | 9/1998 |
| JP | 2000-098791 | 4/2000 |
| JP | 2001-175112 | 6/2001 |
| JP | 2001-199613 | 7/2001 |
| JP | 2001-226015 | 8/2001 |
| JP | 2001-337564 | 12/2001 |
| JP | 2002-087675 | 3/2002 |
| JP | 2003-263062 | 9/2003 |
| JP | 2004-139118 | 5/2004 |
| JP | 2004-233966 | 8/2004 |

* cited by examiner

*Primary Examiner* — David Porta
*Assistant Examiner* — Benjamin Schmitt
(74) *Attorney, Agent, or Firm* — Oblon, Spivak, McClelland, Maier & Neustadt, L.L.P.

(57) ABSTRACT

An image forming apparatus which uses toner to form an image on a sheet may cause the sheet to experience curl after passing through a fixing device which uses heat and pressure to fix the toner image on the sheet. A pair of discharge rollers and/or a sheet separating board may be utilized to correct the curl on the sheet, for both thin and heavy paper weights. The angle of the sheet separating board relative to a line which is perpendicular to a sheet discharging direction is preferably set from 75° to 95°, and a nip depth of a pair of sheet discharging rollers is preferably set from 0 mm to 3 mm.

15 Claims, 8 Drawing Sheets

FIG. 11A

FIG. 11 | FIG. 11A | FIG. 11B

| Ex. | SHEET WEIGHT | ANGLE OF SHEET SEPARATING BOARD | NIP DEPTH OF DISCHARGING ROLLERS | OUTER DIAMETER OF DRIVING ROLLER | OUTER DIAMETER OF DRIVEN ROLLER | APPARENT HARDNESS OF DRIVEN ROLLER | APPARENT HARDNESS OF DRIVING ROLLER |
|---|---|---|---|---|---|---|---|
| 1 | 64g/m$^2$ | 110° | — | — | — | — | — |
| | 157g/m$^2$ | 110° | — | — | — | — | — |
| 2 | 64g/m$^2$ | — | 5mm | $\phi$11 | $\phi$16 | 20 | 81 |
| | 157g/m$^2$ | — | 5mm | $\phi$11 | $\phi$16 | 20 | 81 |
| 3 | 64g/m$^2$ | 70° | 0mm | $\phi$12 | $\phi$12 | 30 | 35 |
| | 157g/m$^2$ | 70° | 0mm | $\phi$12 | $\phi$12 | 30 | 35 |
| 4 | 64g/m$^2$ | 90° | 2mm | $\phi$11 | $\phi$13 | 30 | 72 |
| | 210g/m$^2$ | 90° | 2mm | $\phi$11 | $\phi$13 | 30 | 72 |
| 5 | 64g/m$^2$ | 90° | 1mm | $\phi$11 | $\phi$12 | 28 | 60 |
| | 157g/m$^2$ | 90° | 1mm | $\phi$11 | $\phi$12 | 28 | 60 |
| 6 | 64g/m$^2$ | 78° | 1mm | $\phi$11 | $\phi$11 | 31 | 65 |
| | 157g/m$^2$ | 78° | 1mm | $\phi$11 | $\phi$11 | 31 | 65 |
| 7 | 64g/m$^2$ | 92° | 1mm | $\phi$10 | $\phi$11 | 25 | 70 |
| | 157g/m$^2$ | 92° | 1mm | $\phi$10 | $\phi$11 | 25 | 70 |
| 8 | 64g/m$^2$ | 94° | 2mm | $\phi$10 | $\phi$12 | 35 | 66 |
| | 210g/m$^2$ | 94° | 2mm | $\phi$10 | $\phi$12 | 35 | 66 |
| 9 | 64g/m$^2$ | 82° | 0mm | $\phi$12 | $\phi$12 | 31 | 73 |
| | 157g/m$^2$ | 82° | 0mm | $\phi$12 | $\phi$12 | 31 | 73 |
| 10 | 64g/m$^2$ | 85° | 1mm | $\phi$12 | $\phi$14 | 27 | 72 |
| | 157g/m$^2$ | 85° | 1mm | $\phi$12 | $\phi$13 | 27 | 72 |
| 11 | 64g/m$^2$ | 90° | 1mm | $\phi$11 | $\phi$13 | 40 | 58 |
| | 210g/m$^2$ | 90° | 1mm | $\phi$11 | $\phi$13 | 40 | 58 |

FIG. 11B

| d1 | d2 | COEFFICIENT OF FRICTION OF SURFACE OF SHEET SEPARATING BOARD | OUTER DIAMETER OF HEAT-FIXING ROLLER | EVALUATION RESULT OF CURL CORRECTION |
|---|---|---|---|---|
| 5mm | — | 0.26 | φ28 | NG |
| 5mm | — | 0.26 | φ28 | GOOD |
| — | — | — | φ27 | NG |
| — | — | — | φ27 | GOOD |
| 5mm | 180mm | 0.12 | φ35 | GOOD |
| 5mm | 180mm | 0.12 | φ35 | NG |
| 6mm | 140mm | 0.24 | φ27 | GOOD |
| 6mm | 140mm | 0.24 | φ27 | GOOD |
| 6mm | 140mm | 0.25 | φ26 | GOOD |
| 6mm | 140mm | 0.25 | φ26 | GOOD |
| 5mm | 110mm | 0.22 | φ35 | GOOD |
| 5mm | 110mm | 0.22 | φ35 | GOOD |
| 9mm | 240mm | 0.20 | φ24 | NG |
| 9mm | 240mm | 0.20 | φ24 | NG |
| 6mm | 350mm | 0.26 | φ35 | NG |
| 6mm | 350mm | 0.26 | φ35 | NG |
| 4mm | 250mm | 0.57 | φ20 | NG |
| 4mm | 250mm | 0.57 | φ20 | NG |
| 6mm | 210mm | 0.28 | φ42 | GOOD |
| 6mm | 210mm | 0.28 | φ42 | GOOD |
| 15mm | 120mm | 0.19 | φ36 | NG |
| 15mm | 120mm | 0.19 | φ36 | GOOD |

IMAGE FORMING APPARATUS WHICH CORRECTS THE CURL OF A DISCHARGE SHEET

CROSS-REFERENCE TO RELATED APPLICATIONS

The present application claims priority to Japanese Patent Application No. 2006-008498 filed in the Japanese Patent Office on Jan. 17, 2006, the disclosure of which is incorporated herein by reference.

BACKGROUND OF THE INVENTION

1. Field of the Invention

The present invention relates to an image forming apparatus such as a copy machine, a printer, or a facsimile machine which includes a fixing unit and a curl correcting device. The fixing unit uses heat and pressure to fix a toner image on a sheet passing through nip portion formed between the fixing device and a pressing device. The curl correcting device corrects curl of the sheet formed after fixing.

2. Description of the Related Art

In general, in an electrophotographic process of the image forming apparatus, a heat-fixing process for heating a toner image transferred to a sheet is used. However, in the heat-fixing process, sheets are curled by heat, and the curl of the sheet affects sheet feeding and the stacking of the sheets. A conventional image forming apparatus may use a curl correcting device which curls the sheet reversely against the curl of the sheet by increasing the rolling angle of a discharge roller.

For example, a conventional image forming apparatus may be provided with a discharging roller and two subsidiary rollers downstream of the heated fixing-roller which contacts the pressing roller. The curl of the sheet is corrected by cooperation of the discharging roller and the subsidiary rollers.

Japanese Patent Laid-Open Application No. 2004-139118 discloses a sheet fixing device with a curl correcting device which corrects curl made by the fixing portion. Specifically, a protruding portion which corrects curl is provided perpendicular to a straight line between nip formed by a pair of rollers of the fixing device and a nip formed by a pair of discharging rollers.

Additionally, another known curl correcting device curls reversely against the curl of the sheet by changing the outer diameter or hardness of a discharging roller or discharging drum. However, in the fixing unit including the discharging roller with two subsidiary rollers as mentioned above, the amount of reverse curl which is needed varies depending on the type and size of the sheet, so adjustment of the rolling angle of the discharging roller is needed. However, when the pressure of the subsidiary rollers against the discharging roller is increased, the image quality of imprinted sheet is decreased. Additionally, for the fixing unit including discharging roller with two subsidiary rollers as mentioned above, since the two subsidiary rollers pressed against the discharging roller to correct the curl of the sheet and a spring are needed, the cost of the fixing unit increases.

SUMMARY OF THE INVENTION

The present invention has been conceived in response to one or more problems of the related art, and one of its object is to provide an image forming apparatus which corrects curl of a sheet caused by the fixing unit by regulating the sheet discharging direction from fixing device by sheet separating board and/or by the use of sheet discharging rollers.

According to a first embodiment of the invention, an image forming apparatus includes a fixing device configured to fix a toner image using heat and pressure. There is also a sheet separating board, disposed downstream of the fixing device, positioned in a paper path of the imaging forming apparatus and to alter discharging direction of a sheet discharged from the fixing device by contact with the sheet. Further, a pair of sheet discharging rollers is disposed downstream of the fixing device and the sheet separating board and is arranged to correct curl of the sheet discharged from the fixing device. Preferably, an angle of the sheet separating board relative to a line perpendicular to sheet discharging direction of the fixing device is from 75 degrees to 95 degrees and a nip depth of the sheet discharging rollers is from 0 mm to 3 mm.

As an alternative to the above embodiment, the fixing device includes a heating device, a fixing roller and a pressure applying device having an endless belt that is driven by rotation of the fixing roller, According to another embodiment, an image forming apparatus includes, a fixing device configured to fix a toner image using heat and pressure, a first decurling means for correcting curl of the sheet discharged from the fixing device by altering a direction of the sheet, and a second decurling means for correcting curl of the sheet after the sheet has contacted the first decurling means.

BRIEF DESCRIPTION OF THE DRAWINGS

A more complete appreciation of the present invention, and many of the attendant advantages thereof, will be readily obtained as the same becomes better understood by reference to the following detailed description when considered in connection with the accompanying drawings, wherein:

FIG. 11A and FIG. 11B show parameters of different configurations of an image forming device and an evaluation of a curl correction.

DETAILED DESCRIPTION OF THE PREFERRED EMBODIMENTS

Figure 1:
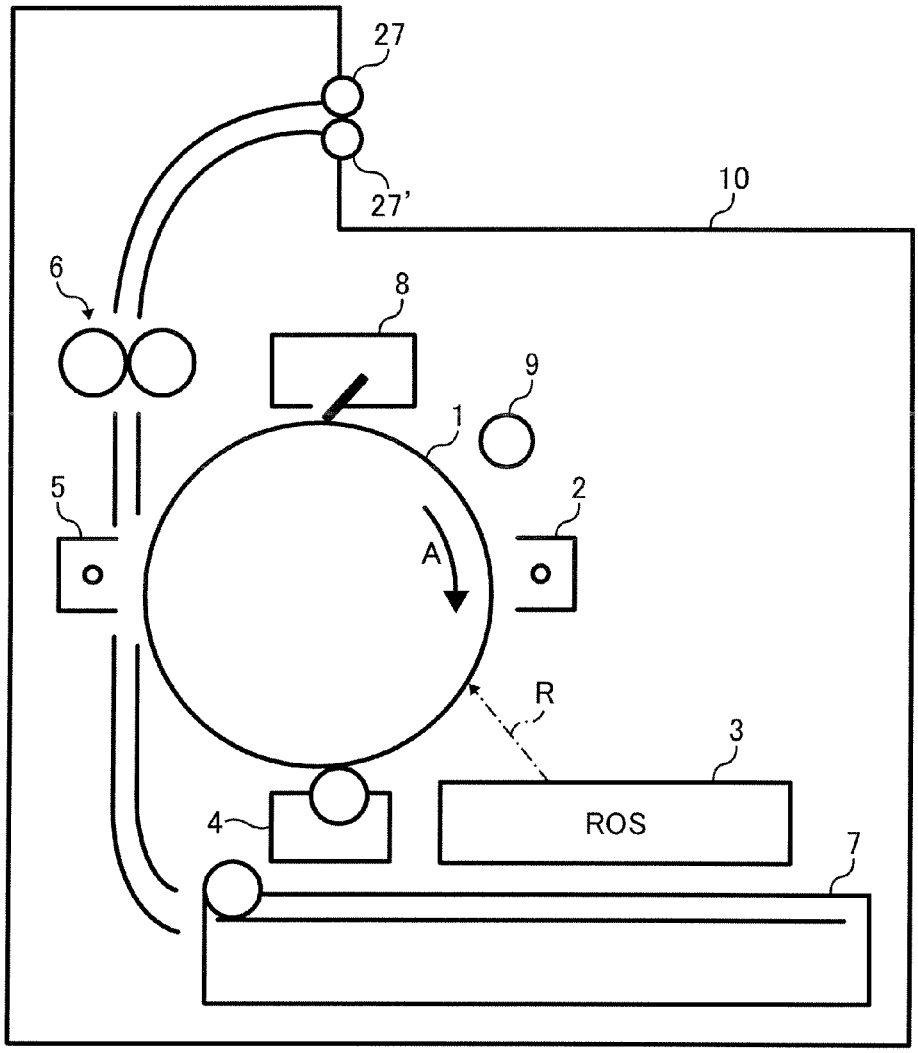
FIG. 1 is a cross-section view showing an overall configuration of an image forming apparatus according to an embodiment of the present invention.

Preferred embodiments of the present invention are described in detail referring to the drawings, wherein like reference numerals designate identical or corresponding parts throughout the several views. FIG. 1 is a cross-section view showing an overall configuration of an image forming apparatus according to an embodiment of the present invention. As illustrated in FIG. 1, an image forming apparatus 10 includes a photoconductor 1 rotating in the direction illustrated by an arrow A, a scorotron charger 2 for charging the photoconductor 1, and a ROS 3 (raster output scanner) which is a laser beam irradiating part that forms an electrostatic latent image on the photoconductor drum 1 by a laser beam R modulated by a laser driving signal. While a scorotron charger is illustrated as the charging device, any suitable charging device may be utilized, including a cortrotron, a charging roller, or any other suitable charging device. There is an image developing unit 4 that forms or develops a toner image on the photoconductor 1 by developing the electrostatic latent image with toner, a transfer unit 5 that transfers the toner image on the photoconductor 1 to a sheet P, a fixing unit 6 that fixes the toner image transferred from the photoconductor 1 on the sheet P, a sheet accommodating tray 7 that accommodates the sheet P, a cleaning unit 8 that cleans surface of the photoconductor 1, and a neutralizing unit 9 that neutralizes residual charge.

Image forming proceeds as follows. An original image signal read by any type of image reading unit, for example, from an original sheet using a scanner or formed by a personal computer which is connected to the image forming apparatus, is sent to an image processing unit, and the original image signal is processed in the image processing unit. The processed image signal is sent to the ROS (laser beam irradiating part) 3 in order to modulate the laser beam R. The laser beam R, modulated by the input signal, illuminates the photoconductor 1 which has been equally charged by the scorotron charger with raster data in order to form an electrostatic latent image. The electrostatic latent image formed on the photoconductor 1 is developed by developing unit 4 with toner to form toner image on the photoconductor 1. The toner image is formed on the photoconductor 1 is transported by rotation in the direction illustrated by arrow A toward transfer unit 5 which is opposed to the photoconductor 1. The sheet P accommodated in sheet feeding tray 7 is fed to the nip portion between photoconductor 1 and transfer unit 5, and the toner image is transferred onto the sheet P by the transfer unit 5. The sheet having the toner image thereon is transported and subsequently fixed by the fixing unit 6. The sheet exits the image forming apparatus 10 after passing through a nip formed between discharge rollers 27, 27'. Residual, such as residual toner, on the photoconductor 1 is removed by the cleaning unit 8, residual charge on the photoconductor 1 is neutralized by neutralizing unit 9, and the image forming process is complete.

Figure 2:
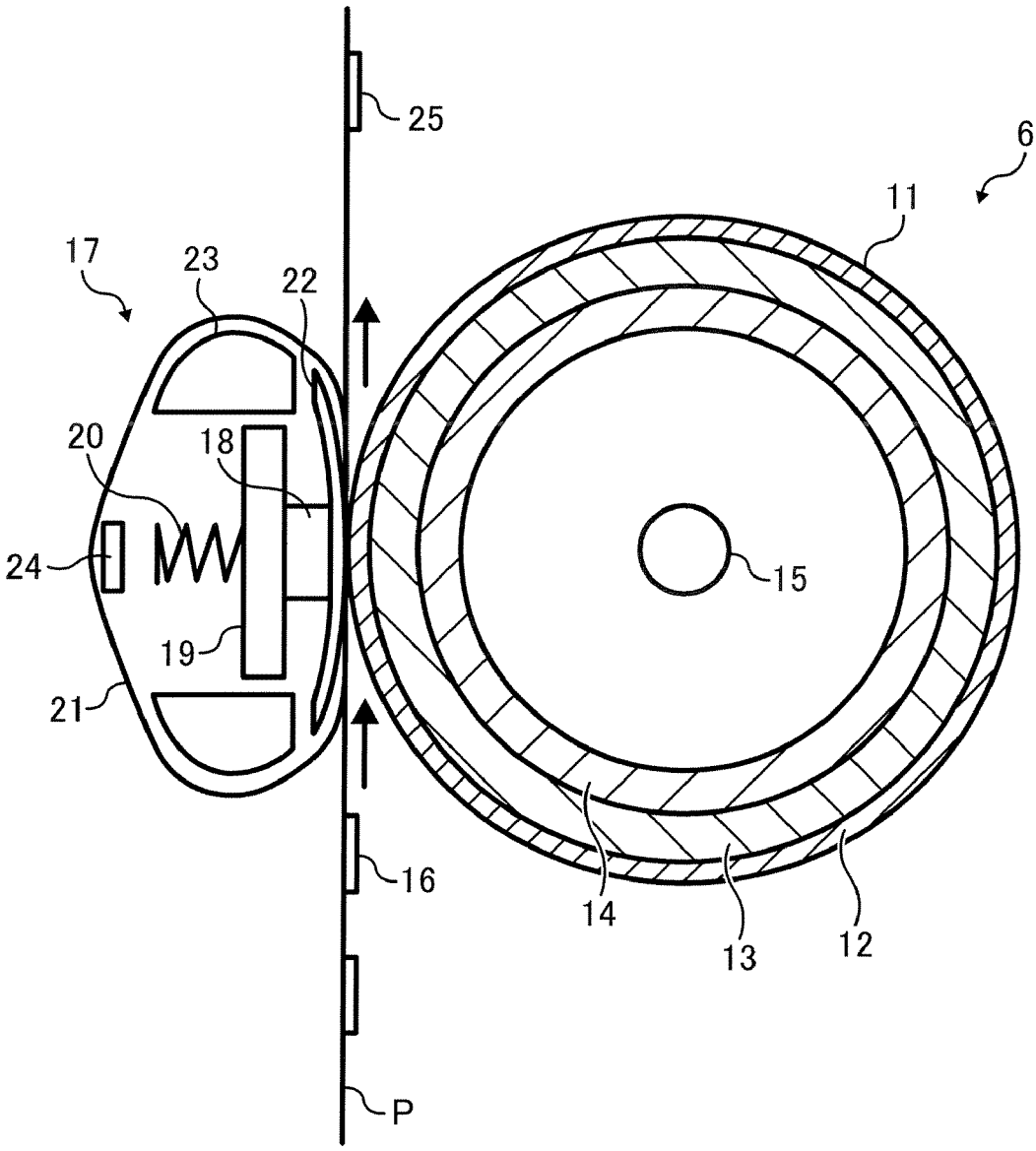
FIG. 2 is a cross-section view showing an overall configuration of a fixing unit of the image forming apparatus of FIG. 1.

FIG. 2 is a cross-section view showing an overall configuration of an exemplary fixing unit 6 which may be used with the present invention. As illustrated in FIG. 2, a heat-fixing roller 11 driven by a driving unit which includes a motor and gears, for example, includes a coated surface layer 12, a resilient layer 13, a core pipe 14, and a heater 15. The sheet P has a toner image 16 that is not yet fixed, and is transported in the direction illustrated by an arrow. A pressure applying device 17 faces the heat-fixing roller 11 on the opposite side of the sheet P. The pressure applying device 17 includes a pressure portion 18, a holding potion 19 that pushes against the pressure portion 18, a pressure spring 20 that presses the pressure portion 18 and the holding potion 19 toward the sheet P. An endless belt 21 is driven by the rotation of the heat-fixing roller 11 around a guide 23 that defines a path of the endless portion 21.

A lubricant oil supplying unit 24 supplies lubricant oil between the endless belt 21 and the pressure portion 18 to decrease friction between the endless belt 21 and the pressure portion 18. Silicon oil or fluorine oil are example lubricants that may be used as the lubricant oil, although any suitable lubricant may be utilized. The unfixed toner image 16 becomes a fixed toner image 25 after passing through the nip formed by the heat-fixing roller 11 and the endless belt 21.

The coated surface layer 12 of the heat-fixing roller 11 may include, for example, TEFLON PFA (perfluoroalkoxy) to prevent adhesion of toner 16. The resilient layer 13 of the heat-fixing roller 11 may include, for example, silicon rubber or fluorine rubber. In the case of silicon rubber, a fluorine layer may be coated on the resilient layer 13 to prevent swelling.

The endless belt 21 may be a flat belt including PFA and a polyimide. The pressure portion 18 includes a rubber layer made of silicon rubber or fluorine rubber and formed as a pressure pad including a flat or rounded surface facing the pressing direction. The sheet may be a cut sheet.

Figure 3:
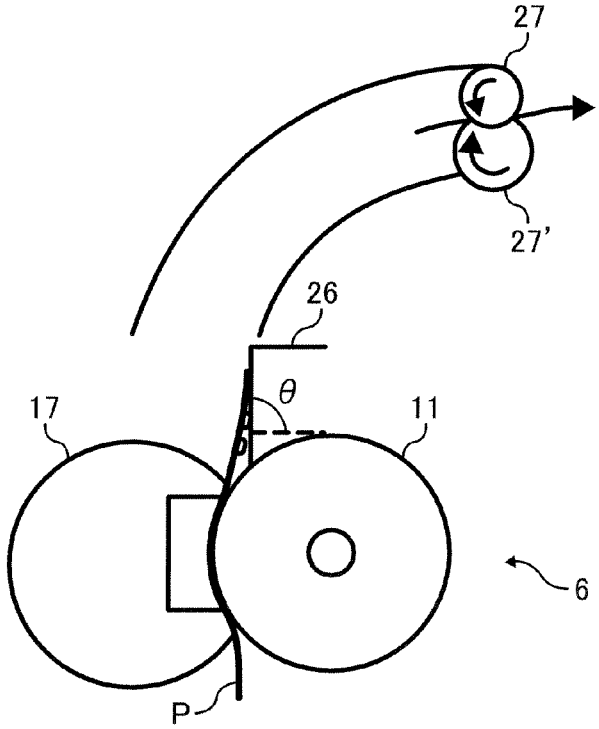
FIG. 3 is a cross-section view of the fixing unit and a pair of sheet discharging rollers along with a sheet separating board arranged at a 90 degree angle.
Figure 4:
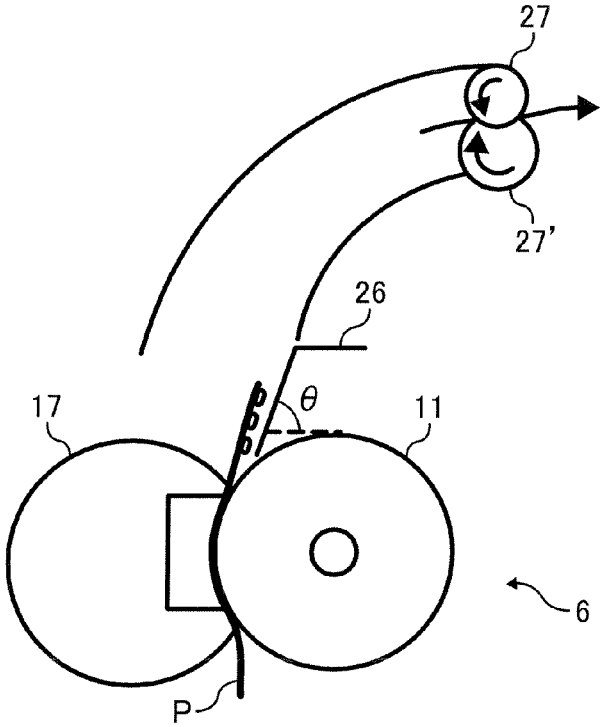
FIG. 4 is a cross-section view of the fixing unit and a pair of sheet discharging rollers along with a sheet separating board arranged at a 70 degree angle.
Figure 5:
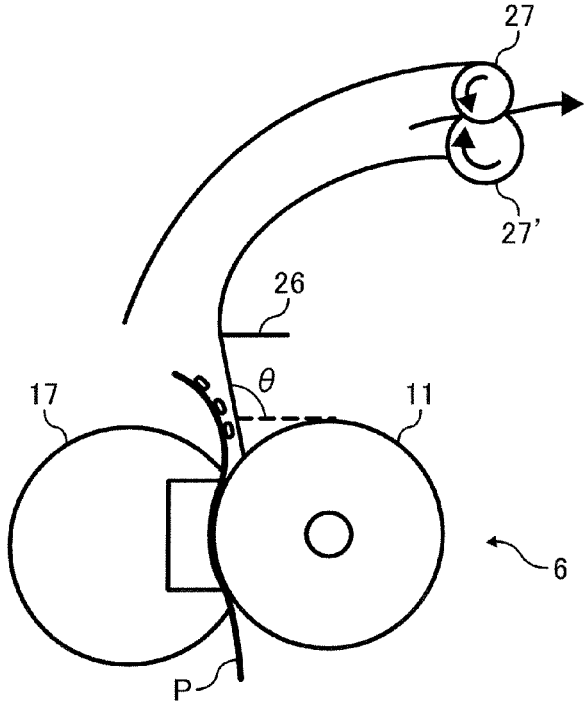
FIG. 5 is a cross-section view of the fixing unit and a pair of sheet discharging rollers along with a sheet separating board arranged at a 110 degree angle.

FIGS. 3-5 show a sheet separating board 26 which corrects the curl of sheet P after the sheet leaves the nip of the fixing device (downstream of the nip) having the heat-fixing roller 11 and the pressure applying device 17. While the figures illustrate a portion of the sheet separating board 26 which is generally perpendicular to the direction of paper travel, such a perpendicular section is not necessary and may be omitted as the paper generally does not contact this portion. There is a pair of discharging rollers including a driving roller 27, and 27' which is a driven roller. Other arrangements of discharge rollers may be used. For example, both rollers may be driven, if desired. The angle of the sheet separating board relative to a line perpendicular to the sheet discharging direction is 90 degrees in FIG. 3, 70 degrees in FIG. 4, and 110 degrees in FIG. 5.

In FIG. 3 which has a 90 degree angle as discussed above, though heavy paper may become curled upon passing through the fixing nip, the curl of the sheet is corrected when the leading edge of the heavy paper contacts the sheet separating board. This type of curl which occurs for heavy paper is referred to as face-curl, meaning curl which conceals the surface of the sheet which has the toner image formed thereon. In FIG. 4 which has a 70 degree angle as discussed above, the leading edge of heavy paper does not hit the sheet separating board, and therefore the face-curl may not be corrected because the angle is too small. In FIG. 5 which has a 110 degree angle as discussed above, thin paper may have back-curl (curl which exposes the surface of the sheet having the toner image formed thereon), the leading edge of the thin paper does not hit the sheet separating board and the curl is not corrected. Since the sheet has uncorrected back-curl, there may be a transportation error or jam of the sheet.

Figure 6:
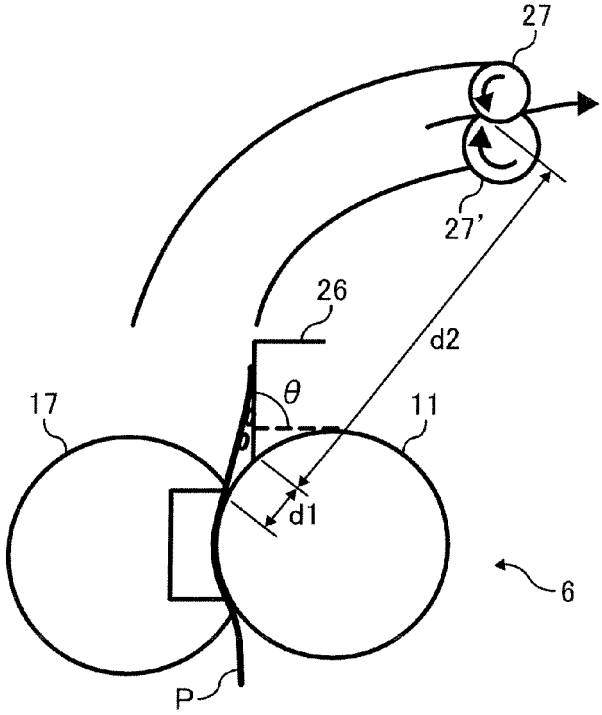
FIG. 6 is a cross-section view of the fixing unit and a pair of sheet discharging rollers showing the distance d1 between the leading edge of the sheet separating board and the trailing edge of the nip portion of fixing device, and the distance d2 between leading edge of the sheet separating board and the leading edge of the nip portion of the pair of sheet discharging rollers.

FIG. 6 shows the distance d1 between the leading edge of the sheet separating board and the trailing edge of the nip portion of the fixing device, and the distance d2 between the leading edge of the sheet separating board and the downstream end of the nip portion of the pair of sheet discharging rollers 27, 27'. The distance d1 between the leading edge of the sheet separating board and the trailing edge of the nip portion of the fixing device is from 3 mm to 8 mm. If d1 is less than 3 mm, the melted toner contacts the leading edge of the separating board 26 and the back side of the sheet may become contaminated or the image quality may otherwise deteriorate. If d1 is greater than 8 mm, the sheet P may wrap around the heat-fixing roller 6 before the leading edge of the sheet P contacts the separating board 26. In this case, the separating board 26 does not separate the sheet P from the heat-fixing roller 6, and therefore the curl of the sheet P may not be correct.

In this embodiment, the distance d2 between the leading edge of the sheet separating board 26 and the beginning of the nip portion of the pair of discharging rollers 27, 27' is set from 60 mm to 290 mm. If d2 is larger than 290 mm, the sheet P having an A4 size when oriented in a longitudinal direction (e.g. the sheet contacts the rollers with a side edge and not the top or bottom thereof) which is discharged from the fixing device 6 does not reach the pair of discharging pair of rollers 27, 27'. After the temperature of the sheet P is decreased or reduced, the curl of the sheet P becomes fixed, permanent or more difficult to remove, and the affect of curl correction may be decreased. If d2 is smaller than 60 mm, since the sheet P is not sufficiently cooled, the sheet P may be imprinted by the discharge rollers 27, 27'.

Figure 7:
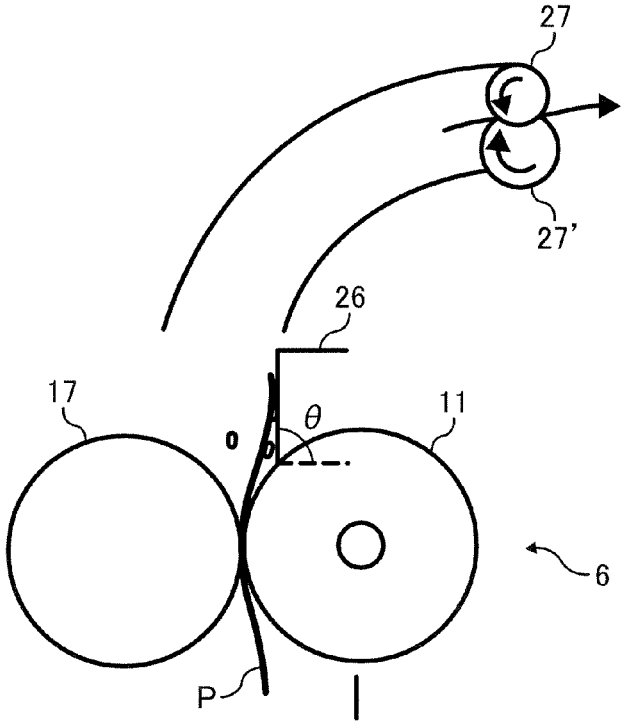
FIG. 7 is a cross-section view of the fixing unit including a heat-fixing roller and a pressure roller, and a pair of sheet discharging rollers of the image forming apparatus according to an embodiment of the present invention.
Figure 8:
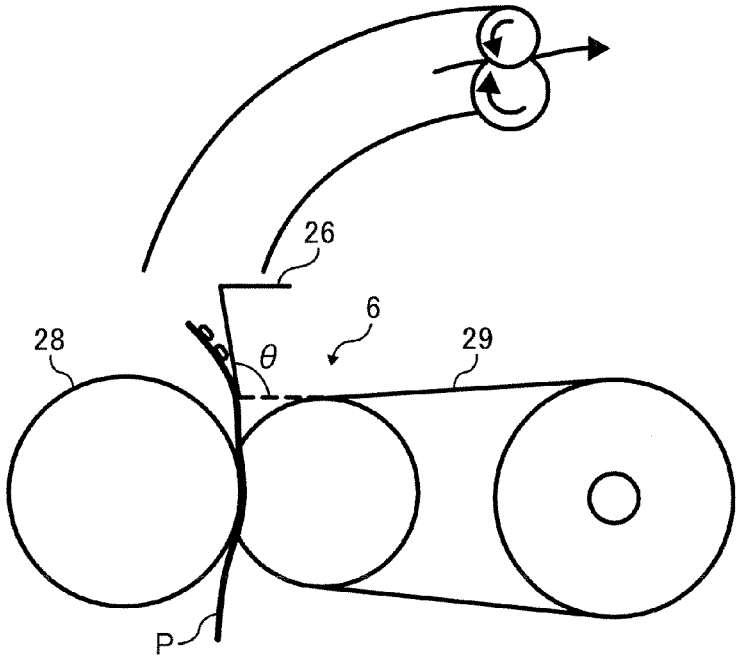
FIG. 8 is a cross-section view of the fixing unit including a heat-fixing belt and a pressure roller, and a pair of sheet discharging rollers of the image forming apparatus according to an embodiment of the present invention.

FIG.7 shows a second embodiment of the nip portion of fixing device, and FIG. 8 shows a third embodiment of the nip portion of fixing device. These figures also show other embodiments of the fixing device illustrated in FIG. 2. In FIG. 7, the fixing unit includes a heat-fixing roller 11 and a pressure roller 28. This pressure roller 26 is an alternative to the pressure applying device 17 of FIG. 2. In FIG. 8, the fixing unit includes a heat-fixing belt 29 and the pressure roller 28. The curl may be decreased by limiting the outer diameter of the pressure roller 28 to be in a range from 20 to 45 mm.

Figure 9:
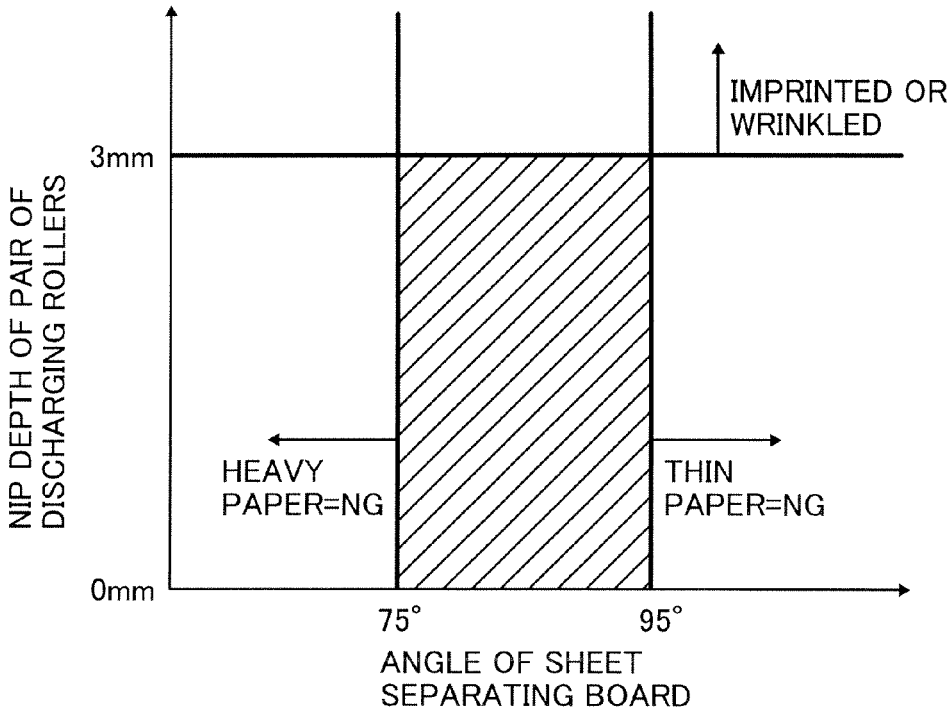
FIG. 9 is a graphical representation of a preferable area, indicated by cross-hatching, as defined by an angle and nip depth of a pair of sheet discharging rollers.
Figure 10:
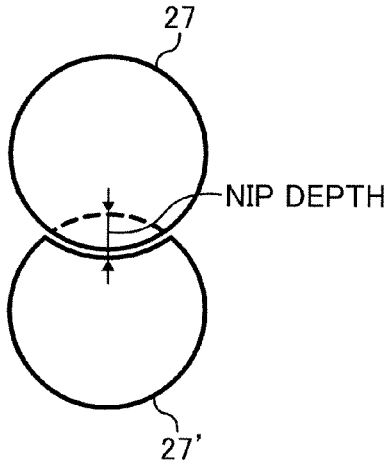
FIG. 10 illustrates the nip depth of discharge rollers 27 and 27'.

FIG. 9 is a graphical illustration of preferable parameters for correcting curl. A first parameter is referred to as a nip depth of the discharge rollers 27, 27'. The nip depth is the combined length that the discharge rollers 27 and 27' rollers deform when pressed against each other. For example, FIG. 10 illustrates the nip depth in an example when rollers 27 and 27' press against each other. In this illustration, roller 27' deforms whereas no deformation is seen for roller 27. However, it is possible to have both rollers deformed when pressed against each other, or only roller 27 deform, as desired. A nip depth of zero (or substantially zero) means that neither roller has any deformation, or the rollers have substantially zero deformation. A second parameter is the angle of the sheet separating board relative to a line which is perpendicular to the sheet travel direction. In FIG. 9, the hatched area is the area which has good decurling results.

As shown in FIG. 9, good decurling results are obtained when the angle of the separating board relative to a line which is perpendicular to the sheet travel direction is between and including 75 degrees and 95 degrees, and the nip depth of the discharge rollers 27 and 27' is greater than or equal to 0 mm and less than or equal to 3 mm.

When the angle of the sheet separating board relative to a line perpendicular to sheet discharging direction is less than 75 degrees, heavy paper transported has face-curl, does not hit the sheet separating board 26, and the curl is not corrected. When the angle of sheet separating board relative to a line perpendicular to sheet discharging direction is more than 95 degrees, thin paper which has back-curl does not hit leading edge of the sheet separating board 26 and the curl is not corrected. When the nip depth of the pair of sheet discharging rollers is more than 3 mm, the sheet is imprinted or wrinkled. By imprinted, what is meant is that indentation lines are formed by the rollers in the direction of the paper travel. By wrinkled, the paper may become crumpled or wrinkled. Thus, according to one embodiment of the invention, the angle of the sheet separating board relative to a line which is perpendicular to the sheet discharging direction may be set from 75 degree to 95 degree, and the nip depth of a pair of sheet discharging rollers may be set from 0 mm to 3 mm.

The surface of the sheet separating board 26, according to one embodiment, is coated with TEFLON (Registered Trademark), e.g., PFTE or polytetrafluoroethylene, enamel, metal, plastic, or other suitable material. When the sheet P is transported along the surface of the sheet separating board 16 after the leading edge of the sheet P contacts the sheet separating board 26, the sheet P is transported smoothly.

According to one embodiment of the invention, the coefficient of friction of the surface of the sheet separating board 26 is from 0.10 to 0.30. If the coefficient of friction of the sheet separating board 26 is larger than 0.30, when the sheet P is transported along the surface of the sheet separating board 26, the sheet P may not be transported smoothly. However, according to other embodiments of the invention, it may be possible not to have this limited range of the coefficient of friction of the sheet separating board 26 and the coefficient of friction may be higher or lower.

According to another preferred embodiment of the invention, the weight of the sheet P on which an image is formed has a density from 50 g/m$^2$ to 210 g/m$^2$. Such a range in density of the sheet allows the curl of the sheet to be corrected effectively. However, the invention is not limited to just this range, but other or different ranges may be utilized, if desired. According to another embodiment of the invention, the surface of the sheet-discharging rollers 27, 27' may include PFA (perfluoroalkoxypolymer resin). This material allows the sheet and toner to be easily removed from the discharging rollers 27, 27', although other materials may be utilized, if desired.

According to yet another embodiment, the outer diameter of the sheet fixing roller is from 20 to 45 mm. If the outer diameter of the sheet fixing roller is within this range, the curl of the sheet P may be corrected by the separating board 26 and the discharge rollers 27, 27'. Additionally, as the pressure applying device 17, a roller, pad, belt, or other suitable device or combination may be utilized.

The table shown in FIG. 11A and FIG. 11B illustrates eleven different examples of configurations of an image forming device. The first column contains the Example Number, and for each example, two different sheet weights are utilized. When the curl of both sheet weights can be adequately corrected, e.g., "GOOD" in the right-most column of FIG. 11B for both sheet weights, the box containing the example number contains cross-hatching. The other parameters are described below.

In the table of FIG. 11A and FIG. 11B (this is a single table which extends across two drawing sheets), the second column contains two paper weights for each example, one with heavy paper and one with thin paper, an angle of the sheet separating board, the nip depth of the discharging rollers, the outer diameter of the driving roller, the outer diameter of the driven roller, the apparent hardness of the driving roller, the apparent hardness of the driven roller, a distance d1 which is the distance between the leading edge of the sheet separating board 26 and the trailing edge of the nip portion of the fixing device, a distance d2 which is the distance between the leading edge of the sheet separating board 26 and the leading edge of the nip portion of the pair of sheet discharging rollers 27, 27', the coefficient of friction of the surface of the sheet separating board, the outer diameter of the heat-fixing roller, and an indication result of whether the curl was effectively corrected. The hardness can be determined by any desired measuring method. One possible way to measure hardness is based on SRIS010 from the Society of Rubber Industry Japan standard using an Asker C durometer. On a roller, a total of 9 measurement points spaced equally around/along the roller can be utilized and the 9 measurements averaged to determine the apparent hardness, although any measurement technique can be utilized.

After an image is formed on a sheet and the sheet goes through a curl correction process as described herein, the curl correction is evaluated. The sheet is placed on a flat surface and the distance each corner of the sheet is raised off of the flat surface is measured using a ruler, for example. The average of the raised distance of the four corners is subsequently calculated. If the paper has face-curl, the paper is placed on the flat surface face-up; if the paper has back-curl, the paper is placed on the flat surface with the back-side facing upwardly and the measured distances can be indicated by negative numbers. Face-curl, as measured by a ruler, can be indicated by a "+" (or positive), and back-curl can be recorded as "–" (or negative). As an alternative to this manner of recording, any desired manner of evaluating or measuring whether there is an unacceptable amount of curl on the sheet may be utilized.

In the table of FIG. 11A and FIG. 11B, if curl has been adequately corrected, the evaluation result is described as "GOOD" in the right-most column of FIG. 11B. If the curl evaluation result is not good or is considered unacceptable, the evaluation result "NG" is recorded in the right-most column of FIG. 11B. In the left-most column of 11A, the example number is cross-hatched when a good result is indicated for both sheet weights tested for the parameters of the system, as set forth in the table. Additionally, the nip depth of the pair of discharging rollers is preferably the maximum nip depth of the rollers. The preferable examples in the table of FIG. 11A and FIG. 11B exist when there is a "GOOD" in the right-most column for both weights of the paper for the particular example.

EXAMPLE 1

In Example 1 set forth in FIG. 11A and FIG. 11B, the angle of the sheet separating board 26 relative to a line perpendicular to the sheet discharging direction is 110°, and discharging rollers are not provided. In this case, the evaluation result is "NG" (no good) because back-curl of the sheet is not corrected for the thinner or lighter weight sheets because the sheet is not contacting the leading edge of the sheet separating board 26. The evaluation result for heavy paper is "GOOD" as sheets having face-curl are properly corrected because the sheet with face-curl contacts the sheet separating board 26.

EXAMPLE 2

In Example 2, the separating board 26 is not provided. In this case, the evaluation result is "NG" for the lighter weight sheet as the driven roller 27' positioned opposite to the pressure applying device 17 is elastically concaved and back-curl is increased due to the elastically concaved portion, even if the nip depth of the discharging rollers is set to 5 mm or more. Additionally, in this example, this sheet is imprinted and wrinkled. The evaluation result of face-curl correction is "GOOD" for heavy paper in this example because the driven roller 27' is positioned at the opposite side of the pressure applying device 17 which is elastically concaved, and the face-curl is corrected by the elastically concaved portion.

EXAMPLE 3

In Example 3, the angle of the sheet separating board relative to a line perpendicular to the sheet discharging direction is set to be 70°, and the nip depth of the pair of discharging rollers is 0 mm. The curl correction evaluation result is "GOOD" for thin paper because the sheet having back-curl contacts the leading edge of the sheet separating board 26, thus correcting the back-curl. The evaluation result is "NG" for the heavy paper as face-curl is not corrected because the sheet having the face-curl does not contact the sheet separating board 26 sufficiently to properly correct the face-curl.

EXAMPLE 4

In Example 4, the angle of the sheet separating board 26 relative to a line which is perpendicular to the sheet discharging direction is set to 90°, and the nip depth of the pair of discharging rollers is set to 2 mm. The curl correction evaluation result is "GOOD" for thin paper because the thin sheet having back-curl contacts the leading edge of the sheet separating board 26, which properly corrects the back-curl. For heavy paper, the evaluation result for curl correction is also "GOOD" because the sheet having face-curl contacts the sheet separating board 26 and the face-curl of the heavy sheets is properly corrected. Because a good result occurs for both the thin and heavy papers, the curl is properly corrected and therefore, the Example number 4 in the left-most column of the table of FIG. 11A is cross-hatched.

EXAMPLE 5

According to Example 5, the angle of the sheet separating board 26 relative to a line perpendicular to the sheet discharging direction is set to 90°, and the nip depth of the pair of discharging rollers is set to 1 mm. The curl correction evaluation result is "GOOD" for thin paper as sheets having back-curl contact the leading edge of the sheet separating board 26 and the back-curl of the sheet is therefore corrected. The evaluation result for the heavy paper is also "GOOD" because the heavy sheet having face-curl contacts the sheet separating board 26 which corrects the face-curl of the heavy sheet.

EXAMPLE 6

In Example 6, the angle of the sheet separating board 26 relative to a line perpendicular to the sheet discharging direction is set to be 78°, and nip depth of the discharging rollers is set to 2 mm. The curl correction evaluation result for thin paper is "GOOD" because thin sheets having back-curl contact the leading edge of the sheet separating board 26 in order to correct the back-curl. The evaluation result of heavy paper is also "GOOD" because the heavy sheets having face-curl contact the sheet separating board 26, thus correcting the face-curl of the heavy sheet.

EXAMPLE 7

In Example 7, the distance d1 is set to 9 mm. The other parameters are as listed in the table. The curl correction evaluation result for thin paper is "NG" because thin sheets having back-curl are not corrected because the sheet having back-curl does not contact the leading edge of the sheet separating board 26. The curl correction evaluation result for heavy paper is "NG" as sheets having face-curl are not corrected enough likely because the face-curled sheets barely contact the sheet separating board 26.

EXAMPLE 8

In Example 8, the distance d2 is set at 350 mm. The curl correction evaluation result for thin paper is "NG" as the thin paper experiences back-curl which is not sufficiently corrected. The curl correction evaluation result for heavy paper is similarly "NG" as the heavy sheets having face-curl are not sufficiently corrected because the temperature of the sheet is similarly decreased, and the face-curl is attempted to be fixed when the heavy sheet is sent to the pair of discharging rollers.

EXAMPLE 9

In Example 9, the coefficient of friction of the sheet separating board is 0.57. The curl correction evaluation result for thin paper is "NG" as the thin paper experiencing back-curl may jam in the sheet discharging path when the sheet is transported along the surface of the sheet separating board having such a high coefficient of friction. For heavy paper, the curl correction evaluation result is "NG" as the toner on the sheet may adhere to the leading edge of the sheet separating board 26.

EXAMPLE 10

In Example 10, the angle of the sheet separating board 26 relative to a line which is perpendicular to the sheet discharging direction is set to 85°, and the nip depth of the pair of discharging rollers is set to 1 mm. The curl correction evaluation result for thin paper is "GOOD" as thin paper having back-curl contacts the leading edge of the sheet separating board 26 and back-curl of the thin sheets is properly corrected. The curl correction evaluation result for heavy paper in this example is also "GOOD" because the heavy sheet having face-curl properly contacts the sheet separating board 26, thus correcting the face-curl of the heavy sheets.

EXAMPLE 11

In Example 11, the apparent hardness of the driving roller is larger than the apparent hardness of the driven roller. The difference in the apparent hardness in the driving roller and the driven roller is 18, and the distance d1 is set to 15 mm. The curl correction evaluation result for thin paper is "NG" as thin paper having back-curl does not properly contact the leading edge of the sheet separating board 26. The evaluation result for the heavy paper is "GOOD".

Obviously, numerous modifications and variations of the present invention are possible in light of the above teachings. It is therefore to be understood that within the scope of the appended claims, the invention may be practiced otherwise than specifically described herein.

What is claimed as new and desired to be secured by Letters Patent of the United States is:

1. An image forming apparatus, comprising:

a fixing device configured to fix a toner image using heat and pressure, the fixing device including a fixing roller, a pressure pad, an endless belt, and a heater, the fixing roller contacting an unfixed toner image on a sheet, and the heater disposed inside the fixing roller, the fixing device creating a curl on the sheet due to the fixing roller creating a concave shape in the pressure pad;

a sheet separating board, disposed downstream of the fixing roller, positioned in a paper path of the imaging forming apparatus to separate the sheet from the fixing roller and to alter a discharging direction of the sheet which is discharged from the fixing device by contact with the sheet, the sheet separating board including a single surface which contacts the sheet without another surface thereof contacting the sheet; and a pair of sheet discharging rollers, disposed downstream of the fixing device and the sheet separating board, arranged to correct the curl of the sheet discharged from the fixing device by a concave shape in one of the sheet discharging rollers which is on a side of the sheet which is opposite to a side which has the pressure pad with the concave shape, wherein an angle of the sheet separating board at a section of the sheet separating board next to the fixing roller relative to a line perpendicular to the sheet discharging direction of the fixing device is from 75 degrees to 95 degrees and a nip depth of the sheet discharging rollers is from 0 mm to 3 mm.

2. The image forming apparatus according to claim 1, wherein:

the pair of sheet discharging rollers includes a driving roller and a driven roller, an apparent hardness of the driving roller is larger than an apparent hardness of the driven roller, a difference of apparent hardness between the driving roller and the driven roller is more than 30, an outer diameter of driving roller is smaller than an outer diameter of the driven roller, and a difference of the outer diameter between the driving roller and the driven roller is 3 mm or less.

3. The image forming apparatus according to claim 1, wherein a distance between a trailing edge of a nip portion of the fixing device and a leading edge of the sheet separating board is from 3 mm to 8 mm.

4. The image forming apparatus according to claim 1, wherein a distance between a leading edge of the sheet separating board and a leading edge of nip portion of the pair of discharging rollers is from 60 mm to 290 mm.

5. The image forming apparatus according to claim 1, wherein a surface of the sheet separating board comprises at least one of polytetrafluoroethylene and enamel.

6. The image forming apparatus according to claim 1, wherein the coefficient of friction of a surface of the sheet separating board which contacts a fixed sheet is from 0.10 to 0.30.

7. The image forming apparatus according to claim 1, further comprising:

a sheet on which the toner image is fixed having a weight from 50 g/m$^2$ to 210 g/m$^2$.

8. The image forming apparatus according to claim 1, wherein a surface of the sheet-discharging roller comprises PFA (perfluoroalkoxy polymer resin).

9. The image forming apparatus according to claim 1, wherein the sheet fixing device includes a sheet fixing roller having an outer diameter from 20 mm to 45 mm.

10. The image forming apparatus according to claim 1, wherein the fixing device is configured to having nip portion at least partially defined by at least one of a roller and a pad.

11. An image forming apparatus, comprising:

a fixing device configured to fix a toner image using heat and pressure, the fixing device including a fixing roller, a pressure pad, an endless belt, and a heater, the fixing roller contacting an unfixed toner image on a sheet, and the heater disposed inside the fixing roller, the fixing device creating a curl on the sheet due to the fixing roller creating a concave shape in the pressure pad;

a decurling and separating means for correcting curl of a sheet discharged from the fixing device by altering a direction of the sheet and for separating the sheet from the fixing device, the decurling and separating means including a single surface which contacts the sheet without another surface thereof contacting the sheet; and a pair of sheet discharging rollers, disposed downstream of the fixing device and the decurling means, arranged to correct the curl of the sheet discharged from the fixing device by a concave shape in one of the sheet discharging rollers which is on a side of the sheet which is opposite to a side which has the pressure pad with the concave shape;

wherein the decurling and separating means is positioned such that an angle of at least a portion thereof at a section of the decurling and separating means next to the fixing roller with respect to a line which is perpendicular to a discharge direction of the fixing device is from 75 degrees to 95 degrees, the sheet discharging direction is a tangent of the fixing roller in a nip of the fixing device.

12. An image forming apparatus according to claim 11, wherein:

the pair of sheet discharging rollers has a nip depth from 0 mm to 3 mm.

13. An image forming apparatus, comprising:

a fixing device that includes a heating device, a fixing roller and a pressure applying device having an endless belt that is driven by rotation of the fixing roller, the fixing roller contacting an unfixed toner image on a sheet, and the heater disposed inside the fixing roller, the fixing device creating a curl on the sheet due to the fixing roller creating a concave shape in the pressure pad;

a sheet separating board, disposed downstream of the fixing roller, positioned in a paper path of the imaging forming apparatus to separate a sheet from the fixing device and to alter a discharging direction of the sheet discharged from the fixing device by contact with the sheet, the sheet separating board including a single surface which contacts the sheet without another surface thereof contacting the sheet; and a pair of sheet discharging rollers, disposed downstream of the fixing device and the sheet separating board, arranged to correct the curl of the sheet discharged from the fixing device by a concave shape in one of the sheet discharging rollers which is on a side of the sheet which is opposite to a side which has the pressure pad with the concave shape, wherein an angle of the sheet separating board at a section of the sheet separating board next to the fixing roller relative to a line perpendicular to the sheet discharging direction of the fixing device is from 75 degrees to 95 degrees and a nip depth of the sheet discharging rollers is from 0 mm to 3 mm, wherein the sheet discharging direction is a tangent of the fixing roller in a nip of the fixing device.

14. An image forming apparatus, comprising:

a fixing device configured to fix a toner image using heat and pressure, the fixing device including a fixing roller, a pressure pad, an endless belt, and a heater, the fixing roller contacting an unfixed toner image on a sheet, and the heater disposed inside the fixing roller, the fixing device creating a curl on the sheet due to the fixing roller creating a concave shape in the pressure pad;

a sheet separating board, disposed downstream of the fixing roller, positioned in a paper path of the imaging forming apparatus to separate the sheet from the fixing roller and to alter a discharging direction of the sheet which is discharged from the fixing device by contact with the sheet, the sheet separating board located at the same side of a paper path as the fixing roller, and located at an opposite side of the paper path as the pressure pad, the sheet separating board including a single surface which contacts the sheet without another surface thereof contacting the sheet; and a pair of sheet discharging rollers, disposed downstream of the fixing device and the sheet separating board, arranged to correct the curl of the sheet discharged from the fixing device by a concave shape in one of the sheet discharging rollers which is on a side of the sheet which is opposite to a side which has the pressure pad with the concave shape, wherein an angle of the sheet separating board at a section of the sheet separating board next to the fixing roller relative to a line perpendicular to the sheet discharging direction of the fixing device is from 75 degrees to 95 degrees and a nip depth of the sheet discharging rollers is from 0 mm to 3 mm.

15. An image forming apparatus according to claim 14, wherein:

the line perpendicular to the sheet discharging direction is a line which is parallel to a line from a center of the fixing roller to a midpoint of a nip between the fixing roller and the endless belt which is in contact with the pressure pad.

* * * * *